US008976073B2

(12) United States Patent
Jousset et al.

(10) Patent No.: US 8,976,073 B2
(45) Date of Patent: Mar. 10, 2015

(54) WIDEBAND, DIRECTIONAL, LINEARLY POLARIZED ANTENNA HAVING HIGH POLARIZATION PURITY

(75) Inventors: Michel Jousset, Ploumoguer (FR); Gaetan Guevel, Quimper (FR); Gaelle Samson, Ploumoguer (FR)

(73) Assignee: Thales, Neuilly-sur-Seine (FR)

( * ) Notice: Subject to any disclaimer, the term of this patent is extended or adjusted under 35 U.S.C. 154(b) by 245 days.

(21) Appl. No.: 13/641,031

(22) PCT Filed: Apr. 7, 2011

(86) PCT No.: PCT/EP2011/055419
§ 371 (c)(1),
(2), (4) Date: Jan. 22, 2013

(87) PCT Pub. No.: WO2011/128243
PCT Pub. Date: Oct. 20, 2011

(65) Prior Publication Data

US 2013/0207864 A1 Aug. 15, 2013

(30) Foreign Application Priority Data

Apr. 13, 2010 (FR) ..... 10 01549

(51) Int. Cl.

| | |
|---|---|
| ***H01Q 11/10*** | (2006.01) |
| ***H01Q 9/27*** | (2006.01) |
| ***H01Q 19/02*** | (2006.01) |
| ***H01Q 5/02*** | (2006.01) |

(52) U.S. Cl.
CPC ..... *H01Q 11/105* (2013.01); *H01Q 9/27* (2013.01); *H01Q 11/10* (2013.01); *H01Q 19/028* (2013.01); *H01Q 5/02* (2013.01)
USPC ..... 343/792.5

(58) Field of Classification Search
USPC ..... 343/792.5, 793, 895
See application file for complete search history.

(56) References Cited

U.S. PATENT DOCUMENTS

| | | | | |
|---|---|---|---|---|
| 4,063,249 | A * | 12/1977 | Bergander et al. | 343/756 |
| 4,658,262 | A | 4/1987 | Duhamel | |
| 6,211,839 | B1 * | 4/2001 | Campbell | 343/792.5 |
| 6,731,248 | B2 * | 5/2004 | Killen et al. | 343/792.5 |
| 7,609,220 | B2 * | 10/2009 | Engargiola et al. | 343/792.5 |
| 2005/0104797 | A1 * | 5/2005 | McCollum | 343/895 |

FOREIGN PATENT DOCUMENTS

EP 0 416 300 A2 3/1991

* cited by examiner

*Primary Examiner* — Tan Ho
(74) *Attorney, Agent, or Firm* — Baker & Hostetler LLP

(57) ABSTRACT

In the field of wideband directional antennas employing linear polarization, and in particular in the context of amplitude goniometry systems, polarization purity defects lead to deformation of the radiation diagrams that increases with the elevation, inducing degraded detection system location performance. An antenna is provided operating with linear polarization and having radiating elements of "sinuous" shape inscribed within a circle, and includes radiating elements printed on the two faces of a support, the elements of the first face being deduced from those of the other face by a rotation.

5 Claims, 1 Drawing Sheet

WIDEBAND, DIRECTIONAL, LINEARLY POLARIZED ANTENNA HAVING HIGH POLARIZATION PURITY

CROSS-REFERENCE TO RELATED APPLICATIONS

This application is a National Stage of International patent application PCT/EP2011/055419, filed on Apr. 7, 2011, which claims priority to foreign French patent application No. FR 1001549, filed on Apr. 13, 2010, the disclosures of which are incorporated by reference in their entirety.

FIELD OF THE INVENTION

The present invention relates to a wideband, directional, linearly polarized antenna having high polarization purity.

BACKGROUND

In the field of wideband directional antennas employing linear polarization, and in particular in the context of amplitude goniometry systems, there is generally observed, with antennas of this type, degraded accuracy of the measurement of the D.O.A ("direction of arrival") of targets. In this case, polarization purity defects lead to deformation of the radiation diagrams (this phenomenon is known as "clouding") that increases with the elevation, inducing degraded detection system location performance.

This problem is currently solved with the aid of empirical solutions that cannot be generalized, for example the addition of arrays of metal wires in front of the antenna.

SUMMARY OF THE INVENTION

The subject matter of the present invention is a wideband (the frequency band possibly exceeding a decade), directional antenna having high polarization purity, of the printed circuit type, which antenna can be integrated into a dual polarization antenna and, when it is used in a location system, enable improvement of the location performance thereof, particularly at non-zero elevations.

If this antenna is of the linearly polarized type, its theoretical copolarization is defined relative to the geometry of the radiating circuit. In practice, the real copolarization differs from the theoretical copolarization. The polarization purity is defined as being the difference between the theoretical polarization and the real copolarization. It may be measured using the "copolarization level/cross-polarization level" ratio in the geometrical definition plane of the antenna. If the antenna is perfect, this ratio is infinite. In practice, what is looked for is a ratio generally between 15 dB (for a log-periodic type antenna) and 20 dB (for a "sinuous" antenna).

The antenna of the invention, of the plane support type, is a wideband, directional, linearly polarized antenna having high polarization purity, having at least one pair of radiating elements printed on one face of a printed circuit, the two elements being symmetrical to each other with respect to the center of the antenna and delimited in their angular extent by two virtual straight lines passing through the center of the antenna, and is characterized in that it includes radiating elements printed on the other face of the support, these elements being identical to those of the first face, and being deduced therefrom by a rotation of 180° about an axis passing through the center of the antenna, and which is the bisector of the angle at the center of said pair of elements, this angle at the center being that formed by said two virtual straight lines, this rotation being followed by a translation over a distance equal to the thickness of the printed circuit.

BRIEF DESCRIPTION OF THE DRAWINGS

The present invention will be better understood on reading the detailed description of one embodiment considered by way of nonlimiting example and shown in the appended drawing, in which.

DETAILED DESCRIPTION

The present invention is described hereinafter with reference to an antenna operating with linear polarization and having radiating elements of "sinuous" shape inscribed within a circle, but it is to be clearly understood that it is not limited to any such type of antenna, and that it applies to any antenna with plane radiating elements, radiating with linear polarization, having a wire geometry, where the aim is to improve the polarization purity, the copolarization of which antenna is assumed to be linear, wideband or otherwise, which may, where necessary, be the basic element for the design of a dual polarization antenna.

Figure 1:
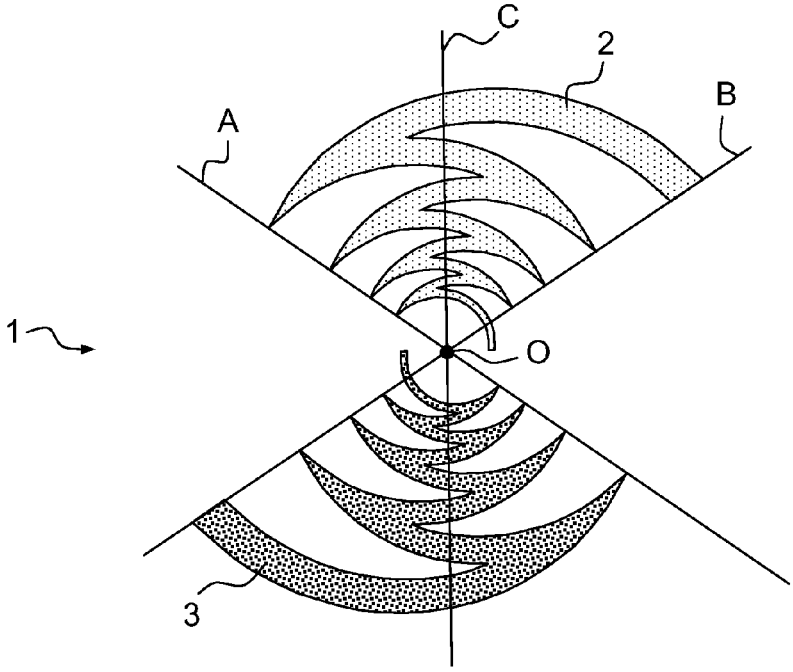
FIG.1 (PRIOR ART)
FIG. 1 is a plan view of a prior art antenna.

The type of antenna from which the invention stems is generally that produced with the aid of a single-sided printed circuit fabrication technology. One example of a prior art antenna 1 of this type is shown in FIG. 1. It essentially comprises two sinuous radiating elements or branches 2, 3 symmetrical to each other with respect to the geometric center O of the system. It is to be clearly understood that this antenna could include two other branches. The layout of the radiating elements of a so-called "sinuous" antenna being well known, for example from U.S. Pat. No. 4,658,262, it will not be described in more detail here. It will be specified here only that the two arms 2, 3 are symmetrical to each other with respect to the center O. These two arms are delimited in their angular extent $\alpha$ by two virtual straight lines A, B passing through the center O of the antenna.

Figure 2:
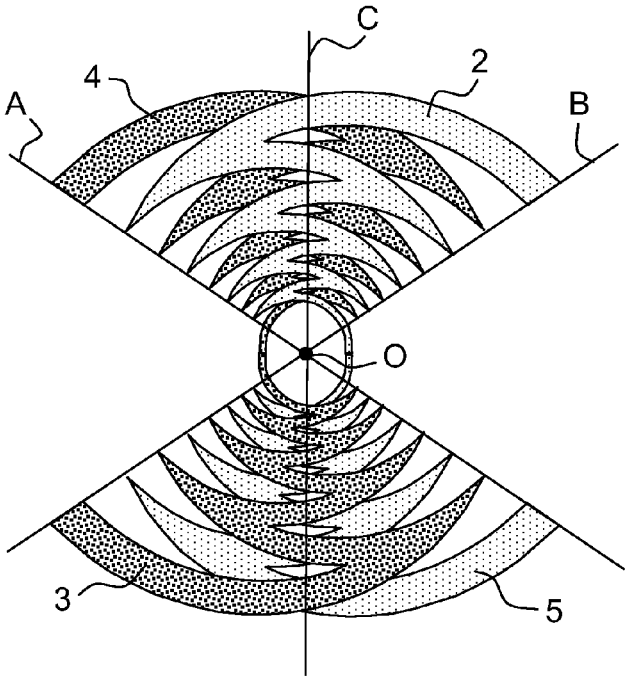
FIG. 2 is a plan view of an antenna conforming to the present invention.

The antenna 4 of the invention, as represented in FIG. 2, is of the double-sided printed circuit type. The representation in FIG. 2 is as if the printed circuit on which the radiating elements are formed were transparent. The first face, which is assumed to be the anterior face, includes the same branches 2, 3 as in FIG. 1. The posterior face of the printed circuit includes the branches 4,5 the shapes and dimensions of which are identical to those of the branches 2, 3.

In the FIG. 2 view, the location of the branches 4, 5 is deduced from that of the branches 2, 3 by rotation to 180° about an axis C passing through the center O and which is the bisector of the angle $\alpha$ at the center of the branches 2, 3. In reality, it would be necessary to add to this rotation a translation over a distance equal to the thickness of the printed circuit (from the anterior face to the posterior face of this printed circuit). In other words, the layout of the branches 4, 5 is obtained by rotation of the branches 2, 3 about the center O through an angle having a value equal to $(180°+\alpha)$, and then by the same translation. In the case of an antenna with four branches (two pairs of branches), only one of the pairs is considered for this rotation.

The invention enables improvement of the polarization purity of the antenna by more than 10 dB compared to the geometry on a single-sided printed substrate. More generally, it enables improvement of the polarization purity of all plane wire antenna geometries (log-periodic and other type antennas). Applied to dual polarization antennas, it improves the coupling between the two radiating elements.

The invention claimed is:

1. A wideband, directional, linearly polarized antenna having a plane support and high polarization purity, having at least one pair of radiating elements printed on one face of a printed circuit, the two elements being symmetrical to each other with respect to a center of the antenna and delimited in their angular extent by two virtual straight lines passing through the center of the antenna, comprising:

radiating elements printed on the other face of the support, these elements being identical to those of the first face, and being deduced therefrom by a rotation of 180° about an axis passing through the center of the antenna and which is the bisector of an angle at the center of said pair of elements, said angle at the center being that formed by said two virtual straight lines, said rotation being followed by a translation over a distance equal to the thickness of the printed circuit.

2. The antenna claimed in claim 1, wherein each face of the printed circuit includes two arms of sinuous shape.

3. The antenna claimed in claim 2, wherein each face of the printed circuit includes two arms of log-periodic shape.

4. The antenna claimed in claim 1, being a dual linear polarization antenna.

5. The antenna claimed in claim 1, wherein each face of the printed circuit includes two arms of log-periodic shape.

* * * * *